US005599210A

United States Patent [19]

Green

[11] Patent Number: 5,599,210

[45] Date of Patent: Feb. 4, 1997

[54] BATTERY TERMINAL CONNECTOR

[76] Inventor: Charles L. Green, 3022 N. Josey La. #105, Carrollton, Tex. 75007

[21] Appl. No.: 603,704

[22] Filed: Feb. 20, 1996

Related U.S. Application Data

[63] Continuation of Ser. No. 80,211, Jun. 17, 1993, abandoned.

[51] Int. Cl.[6] ..... H01R 4/42; H01R 9/11

[52] U.S. Cl. ..... 439/763; 439/623

[58] Field of Search ..... 439/763, 764, 439/623, 624, 502, 504

[56] References Cited

U.S. PATENT DOCUMENTS

| | | | |
|---|---|---|---|
| 3,230,499 | 1/1966 | Haegert | 439/763 |
| 3,407,382 | 10/1968 | Haegert | 439/763 |
| 3,407,383 | 10/1968 | Haegert | 439/763 |
| 3,656,094 | 4/1972 | Haegert | 439/763 |
| 3,739,322 | 6/1973 | Haegert | 439/764 |
| 3,893,744 | 7/1975 | Porazinski | 439/763 |
| 4,354,726 | 10/1982 | Kato et al. | 439/763 |
| 4,575,178 | 3/1986 | Coesfeld et al. | 439/755 |
| 4,740,178 | 4/1988 | Badenhorst et al. | 439/758 |
| 5,087,214 | 2/1992 | Dewar | 439/762 |
| 5,171,169 | 12/1992 | Butcher et al. | 439/763 |

*Primary Examiner*—Gary F. Paumen

*Attorney, Agent, or Firm*—H. Dennis Kelly; Timmons & Kelly

[57] ABSTRACT

A vehicle battery terminal connector and repair system for a battery terminal connector and cable harness. The invention includes a battery terminal connector having a battery terminal adapter portion for affixing the battery terminal connector into electrical contact with the battery terminal; a flat body portion affixed in electrical contact to the adapter portion at a right angle to the battery terminal; and a flexible connector portion affixed in electrical contact to the flat body portion of the terminal connector. Further provided in various embodiments of the present invention are means for removably affixing one or more cables extending from equipment or accessories of a vehicle into electrical contact with the battery terminal connector.

4 Claims, 4 Drawing Sheets

BATTERY TERMINAL CONNECTOR

This application is a continuation of application Ser. No. 08/080,211, filed Jun. 17, 1993, now abandoned.

RELATED DISCLOSURE

This is related to the disclosure filed with the U.S. Patent and Trademark Office as part of the Disclosure Document Program on Jun. 1, 1992, having Ser. No. 310888, filed on Jun. 1, 1992.

BACKGROUND OF THE INVENTION

This invention relates to battery terminal connecting devices which connect a battery mounted within a motor vehicle to electronic equipment or accessories which are components of, or are otherwise mounted to, the motor vehicle and which are operated from electric power supplied from the battery, or which provide electric power to the battery. More particularly, the present invention relates to a new and improved battery terminal connector for releasably connecting to a battery post a plurality of cables leading to vehicle equipment, and a repair system for a battery terminal connector and an associated electrical cable harness.

The use of battery terminal connectors for electrically connecting a vehicle storage battery to electronic equipment mounted within the vehicle is well known. It is conventional to equip a motor vehicle with at least one storage battery for accumulating electricity and supplying electric power to various equipment and accessories provided with the vehicle, such as, for example, an electric radio broadcast receiver, an electric engine starter, vehicle lights, and the like. The typical vehicle battery includes two battery posts, or terminals, to which cables from various electronic equipment may be connected. As the quantity of equipment needing to be connected to a battery of an automobile has increased, the need for electrically connecting a plurality of cables to said battery has likewise increased. Various battery terminal connectors exist within the prior art that address the need for connecting a plurality of cables to a vehicle battery terminal; however, none of the battery terminal connectors of the prior art effectively solve the problems addressed by the present invention.

Many attempts have been made to address the problems associated with trying to electrically connect a plurality of cables to a vehicle battery terminal. Illustrative of the various types of these connectors are U.S. Pat. No. 3,230,499 (Haegert); U.S. Pat. No. 3,407,382 (Haegert); U.S. Pat. No. 3,407,383 (Haegert); U.S. Pat. No. 3,656,094 (Haegert); U.S. Pat. No. 4,354,726 (Kato et al.), and U.S. Pat. No. 4,575,178 (Coesfeld et al.); U.S. Pat. No. 4,740,178 (Badenhorst); and U.S. Pat. No. 5,171,169 (Butcher). In Haegert's disclosures of U.S. Pat. Nos. 3,230,499, 3,307,383, and 3,656,094 is taught the addition of a branch, or laterally extending lug, to the body of a terminal connector for releasably securing an additional cable to the battery terminal. The use of an expansion bolt with extending lug for adding an additional cable to the harness is also taught. Although these devices address the need to connect additional cables to the battery terminal, the number of additional cables which can be added is severely limited. The device of Haegert taught in U.S. Pat. No. 3,407,382 is an attempt to address this problem via the use of a multiple shanked bolt threadably attached to a battery terminal connector. Although this teaching addresses the need to electrically connect a larger number of cables to the battery terminal, a vehicle operator using said device has to deal with the added expense of time and material in securing suitable fasteners to the ends of each cable for connecting said cable to the terminal connector. A further difficulty of this device with which vehicle operators must deal when maintaining the cables connected to said terminal connector, is that of having to work in close-quartered proximity to the fixed ends of multiple heavy gauge cables connected adjacent each other to the battery terminal connector. Those familiar with such efforts will recognize the amount of skill and patience necessary in order to deal effectively with each cable, especially while working within the close confines of a modern vehicle engine compartment. Similar concerns are raised with the teaching of Coesfeld et al., m which is disclosed a battery terminal connector having a plurality of bores therethrough for the mounting of a plurality of cables with appropriate fasteners secured to the ends thereof.

The use of special adapters mounted to the ends of cables for connecting to a battery terminal connector is further taught by Kato et al. and Badenhorst. These likewise have the shortcoming and expense of having to provide and mount special adapters to the ends of cables for connecting to the battery terminal. These disclosures also address the difficulty in the handling of a multitude of stiff adjacent vehicle cable ends within the confines of a modem engine compartment, by teaching means for mounting said cables into a single fixture which is then removably connected to a main battery terminal connector. Even though this technique allows for the maintenance of such cable ends outside the confines of the engine compartment (while the terminal connector is disconnected from the battery post), those skilled in the art know that these methods have not eliminated the difficulty of attempting to connect a plurality of cable ends simultaneously to one terminal connector.

Another teaching in the art which includes the connecting of a plurality of cables to one main connector for a battery terminal is by Butcher et al., in which is likewise disclosed an electrical connection system having separate structure for connecting to the battery terminal and separate structure for connecting to a plurality of cables. One of the more significant differences between this teaching and that of Kato and Badenhorst is the use of threaded fasteners which are seated in both components of the terminal connector, and are associated with apertures for receiving bared cable ends. The device taught by Butcher et al. prevents a vehicle operator from having to provide his own cable end fasteners. However, the problem of having to deal with a plurality of cable connections in one space of close-proximity is still present with this teaching, as well as is the additional operator burden of having to locate a special tool for tightening the seated threaded fasteners. The number of cable ends that can be secured within the device of Butcher et al., however, is severely limited, due to the limitation of the number of cable end apertures which can be placed in the body of the terminal connector without affecting the structural integrity of said connector.

Another problem associated with the disclosure of Butcher et al. and previous disclosures is that associated with the length of the cables being connected to said terminal connector. Those skilled in the art will recognize the cable length problem associated with replacing corroded battery terminal connectors: that of having to trim damaged lengths from the cables which are corroded. Unfortunately, the typical vehicle manufacturer does not include in his original equipment specifications concerning said cables sufficient lengths to allow for the reconnecting of said cables to the battery when an amount of damaged length has been removed. It is not difficult to understand how such a business decision can reduce original equipment costs and provide for additional sales of future cable assemblies.

In the more recent past, an additional technique has been used by vehicle manufacturers to overcome the problems associated with connecting a plurality of cables directly to a battery terminal connector, which became even more difficult to address with the advent of the side-post battery terminal. In this alternate method, cables from equipment needing electrical contact with the battery are brought together and formed into a main cable and/or cable harness, which is typically provided with a connector for releasably connecting to the battery post. With the advent of more electrical accessories, most newer motor vehicles have from one to three auxiliary electrical cable leads associated with such cable harnesses in order to power the various equipment needing electrical contact with the battery. Because of the wide variation between different brands and models of motor vehicles, manufacturers have tended to design these cable harnesses specifically for a particular model of vehicle, which tends to increase significantly the expensive associated with maintaining and/or replacing said cable harnesses. As well, due to the large variety of motor vehicles, it is not cost effective for a typical merchant to stock the quantity of such apparatus necessary to service a wide variety of customers, which has further precipitated a high cost of repair for such connector/cable assemblies.

In addition to containing cables of various lengths and gauges to match the specifications of a particular model of motor vehicle, modem battery terminal connectors and cable harnesses have included the addition of multiple fusible links, which are used to divide the larger cables connected directly to the battery terminal connector into smaller cables, and to provide an additional fuse protection system for the vehicle electrical system. Although the idea of reducing the number of cables which are directly connected to a battery terminal connector addresses a common problem associated with battery terminal connectors (that being the difficulty of handling simultaneously a plurality of heavy gauge cables which are connected to a single terminal connector), the addition of fusible links to this assembly has added a substantially weaker section to the electrical cabling system, thereby reducing the useable life of the associated cable harness. The need for a cost effective battery terminal connector and cable harness repair system for a motor vehicle is evident.

It will be obvious to those skilled in the art that although the battery terminal connectors disclosed in the prior art may be suitable for the particular purpose to which they address, they would not be as suitable for the purposes of the present invention. Perhaps the most significant unsolved problems associated with said prior art include the added maintenance expense of having to provide additional equipment such as cable fasteners (both common and those of a special design) or special cable seating tools, the difficulty of having to connect and work with the connection of a plurality of stiff motor vehicle cables attached to a single device in very close proximity, and the relatively significant expense in time and money associated with the repair and replacement of multi-lead battery terminal connectors and cable harnesses, especially those made inoperable due to excessive corrosion or an electrically broken fusible link. Although the prior art includes many attempts to increase the number of cables electrically connected to a battery terminal and to reduce the expense of maintaining and replacing said cables and battery terminal connectors, none has achieved the purposes of the present invention.

SUMMARY OF THE INVENTION

In view of the foregoing disadvantages inherent in the known types of battery terminal connectors and cable harnesses now present in the prior art, the present invention provides an improved battery terminal connector for connecting a plurality of cables to a motor vehicle battery and a repair system for a battery terminal connector and an associated cable harness. As such, the general purpose of the present invention, which is described in greater detail below, is to provide a new and improved battery terminal connector and cable harness repair system for a motor vehicle which has all the advantages of the prior art and none of the disadvantages. To attain this, representative embodiments of the concepts of the present invention are illustrated in the appended drawings.

The objective of the drawings and the corresponding detailed description herein, is to illustrate various embodiments of the battery terminal connector and repair system for a battery terminal connector with electrical wiring harness of the present invention, all of which make use of a battery terminal adapter portion for affixing the battery terminal connector into electrical contact with the battery terminal; a flat body portion affixed m electrical contact to the adapter portion at a right angle to the battery terminal; and a flexible connector portion affixed in electrical contact to the flat body portion of the terminal connector. Further provided in various embodiments of the present invention are means for removably affixing one or more cables extending from equipment or accessories of a vehicle into electrical contact with the battery terminal connector.

It is therefore an object of the present invention to provide a new and improved battery terminal connector which has all the advantages of the prior art battery terminal connectors and none of the disadvantages.

It is a further object of the present invention to provide a new and improved battery terminal connector for connecting a plurality of cables to a battery terminal of a motor vehicle.

It is a further object of the present invention to provide a new and improved battery terminal connector which allows for the inexpensive maintenance, repair and replacement of one or more electric cables connected to a vehicle battery terminal.

It is another object of the present invention to provide a new and improved battery terminal connector which provides for ease and efficiency in the maintenance, repair and replacement of a single electrical cable that is connected to a motor vehicle battery terminal to which a plurality of other electrical cables are connected.

It is yet a further object of the present invention to provide a new and improved battery terminal connector which allows for the convenient connection, maintenance, repair and replacement of a plurality of auxiliary electrical cables to a single motor vehicle battery terminal.

It is a further object of the present invention to provide a new and improved battery terminal connector which can work in conjunction with existing motor vehicle cable harnesses and systems, including those designed for either top-post and/or side-post battery terminals.

It is another object of the present invention to provide a new and improved battery terminal connector which may be easily adapted for use with a wide variety of motor vehicles.

It is another object of the present invention to provide a new and improved battery terminal connector which may be easily and efficiently manufactured and marketed.

It is still a further object of the present invention to provide a new and improved battery terminal connector which is of durable and reliable construction.

It is yet still further object of the present invention to provide a new and improved battery terminal connector which meets all federal, state, local and other private standards, guidelines, regulations and recommendations with respect to safety, environmental friendliness, energy conservation, etc.

An even further object of the present invention is to provide a new and improved battery terminal connector which is susceptible of a low cost of manufacture with regard to both materials and labor, and which accordingly is then susceptible of low prices of sale to the consuming public, thereby making such a battery terminal connector economically available to the buying public.

These together with other objects of the invention, along with the various features of novelty which characterize the battery terminal connector of the present invention, are pointed out with particularity in the claims appended hereto and forming a part of this disclosure. For a better understanding of the invention, its operational advantages and the specific objects attained by its uses, reference should be made to the accompanying drawings and descriptive matter in which there are illustrated various embodiments of the invention.

There has thus been outlined, rather broadly, the more important objects of the present invention in order that the detailed description thereof which follows may be better understood, and in order that the present contribution to the art may be better appreciated. There are of course additional features of the invention that are described hereinafter and which form the subject matter of the claims appended hereto. Those skilled in the art will readily ascertain, however, that the invention is capable of other embodiments and of being practiced and carried out in various ways other than those illustrated herein. In this respect, the details of construction disclosed herein, and the arrangements of the components set forth in the following description and appended drawings are for illustrative purposes, only, and are not intended to be limiting in scope. Those skilled in the art will appreciate, as well, that the conception upon which this disclosure is based, may readily be utilized as a basis for the designing of other structures, methods and systems for carrying out the several purposes of the present invention. Said other structures may include, but not be limited to, those which are aesthetic in nature, as well as those which include the substitution of other materials as they become available, and which substantially perform the same function in substantially the same manner with substantially the same results as the present invention. It is important, therefore, that the claims appended hereto be regarded as including such equivalent structures, constructions, methods and systems insofar as these do not depart from the spirit and scope of the present invention.

BRIEF DESCRIPTION OF THE DRAWINGS

The invention will be better understood and objects other than those set forth above will become apparent when consideration is given to the following detailed description. Such description makes reference to the appended drawings, wherein.

DETAILED DESCRIPTION OF VARIOUS EMBODIMENTS

Figure 1:
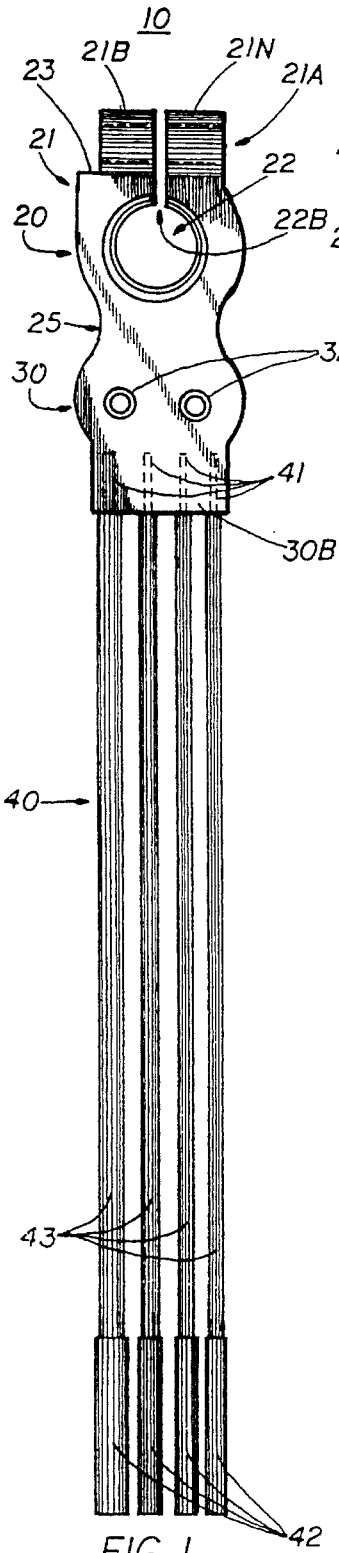
FIG. 1 is a bottom plan view of an embodiment of the invention.

The present invention comprises a battery terminal connector for releasably connecting a plurality of cables extending from equipment and/or accessories of a vehicle to a battery terminal, and a repair system for a battery terminal connector having an associated electrical cable harness. FIGS. 1 through 7 of the appended drawing illustrate a first embodiment of a battery terminal connector 10 of the present invention, with the remaining figures illustrating additional embodiments. (All like numerical designations in the various figures of the appended drawing represent the same element.) Upon reference to the various figures, it will be noted that the battery terminal connector and battery terminal connector repair system of the present invention includes a battery terminal adapter portion for affixing the battery terminal connector into electrical contact with a battery terminal, a flat body portion affixed in electrical contact to the terminal adapter portion, and a flexible connector portion affixed in electrical contact to the flat body portion for affixing one or more cables extending from vehicle equipment or accessories into electrical contact with the battery terminal. Further provided in various embodiments of the present invention are means for affixing one or more cables extending from equipment or accessories of the vehicle into electrical contact with the battery terminal connector. Some variations exist between the different illustrated embodiments, which are specifically pointed out herein, and which fall within the scope of the invention.

An embodiment of a battery terminal connector 10 according to the present invention is illustrated in FIGS. 1 through 7, in which a battery terminal adapter portion 20 comprises a resilient battery terminal clamp 21 having a circular opening 22 therethrough with a diameter substantially equal to the diameter of a battery terminal and further which is suitably tapered to receive a correspondingly tapered battery terminal in the usual manner. The resilient battery terminal clamp 21 includes a bifurcated end 22B comprising a pair of spaced, outwardly extending arms 21B and 21N, each having an aligned aperture 21A therethrough for receiving a clamping bolt 71, such that said clamping bolt 71 is perpendicular to the battery terminal when the circular opening 22 of the battery terminal clamp 21 is affixed to a battery terminal in operative position. The clamping bolt 71 includes a generally cylindrical threaded shank portion which extends at right angles from a substantially flat head portion 71H at a first end, for threadably receiving a nut 71N at the other end thereof. A flat surface or shoulder 23 is formed at the rear of extending arm 21B for cooperating with the head 71H of the bolt 71 to prevent turning of said bolt 71 when mounted in operative position. After said battery terminal is received in the circular opening 22, the nut 71N is tightened onto the bolt 71, thereby drawing said extending arms 21B and 21N toward each other and affixing the circular opening 22 into secure cooperation and electrical contact with the battery terminal.

A flat body portion 30 is affixed in electrical contact to the resilient battery terminal clamp 21 via a neck portion 25, which extends from the terminal clamp 21 at a substantially right angle to the battery terminal and opposite the extending arms 21B and 21N. The flat body portion 30 comprises an upper surface 30T, a lower surface 30B, a pair of side surfaces 30S and a rear surface 30R, each of which is substantially flat and in edge-to-edge contact with at least three other of said surfaces at substantially right angles. The flat body portion further includes a longitudinally extending groove or channel 34 in the top surface extending across a width of the flat body portion in a direction substantially parallel a line drawn through a diameter of the circular opening 22 of the battery terminal clamp 21 and a space between said outwardly extending arms 21B and 21N. The flat body portion 30 further includes a pair of bolt receiving holes 32 extending through said flat body portion 30 substantially perpendicular to and on either side of said channel 34.

It is preferred that said flat body-, neck-, and terminal adapter- portions 30, 25, and 20 of the battery terminal connector 10, respectively, be formed as an integral unit via a die casting process with an inexpensive and highly conductive metal, such as lead or the like which are of common use in vehicle battery terminal connectors. However, those skilled in the art will be aware of other materials, design and methods of manufacture that may be as suitable and fall within the scope of the present invention.

Figure 2:
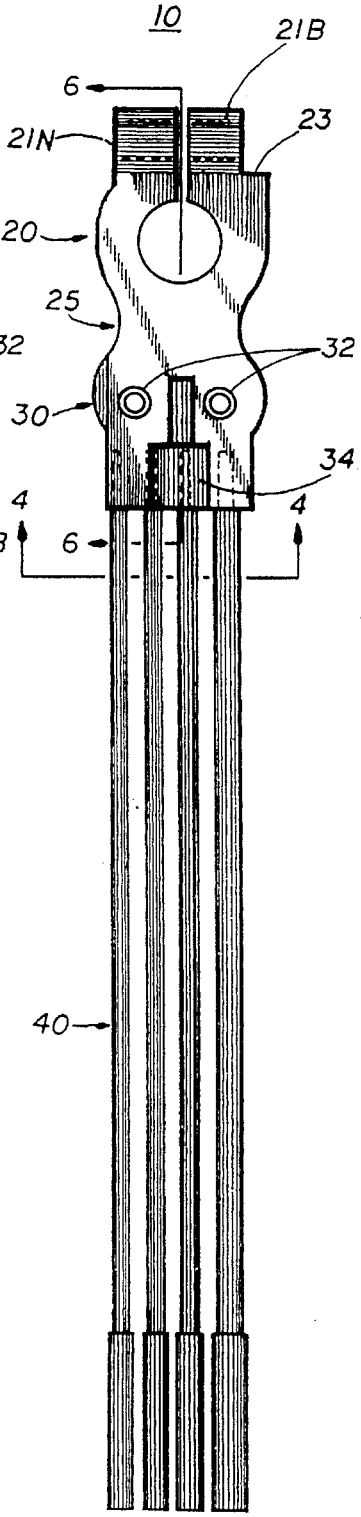
FIG. 2 is a top plan view of the embodiment of FIG. 1.
Figure 3:
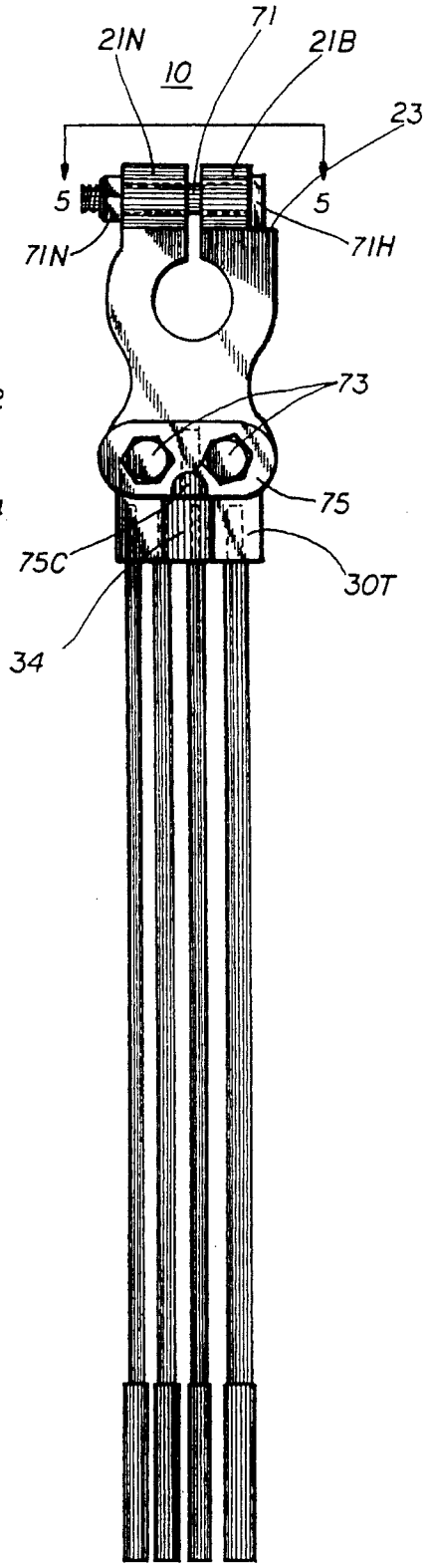
FIG. 3 is a top plan view of the embodiment of FIG. 1 with a cable clamp and securing bolts connected thereto.
Figure 4:
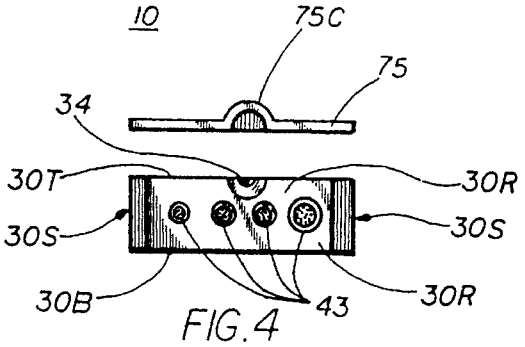
FIG. 4 is a sectional view along line 4—4 of FIG. 2.
Figure 5:
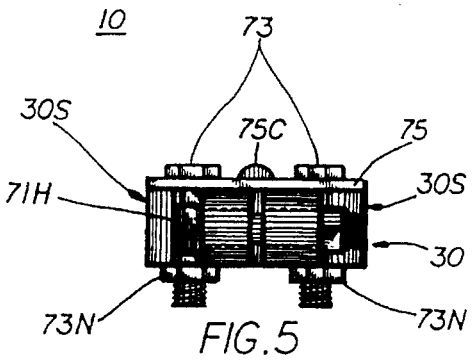
FIG. 5 is a sectional view along line 5—5 of FIG. 3.
Figure 6:
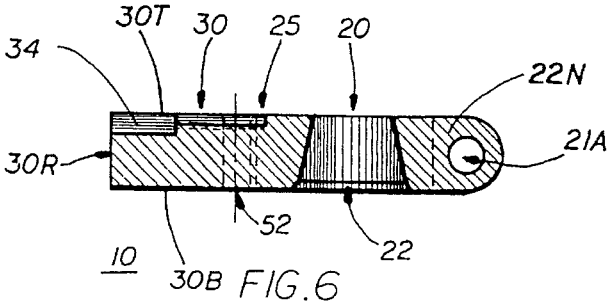
FIG. 6 is a sectional view along line 6—6 of FIG. 2.
Figure 7:
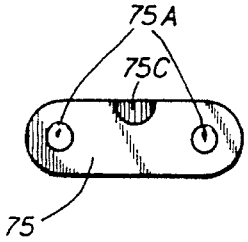
FIG. 7 is a top plan view of the cable clamp of the embodiment of FIG. 3.

Intersecting the rear surface 30R at substantially right angles is a flexible connector portion 40, which comprises a plurality of flexible connector segments. An embodiment of said connector segments is illustrated in FIGS. 1 through 3 as a plurality of insulated electrical connector cables 43. Each of said cables 43 includes a first end 41 affixed in electrical contact to said flat body portion 30; contact means for affixing a second end of the cable 43 into electrical contact with a vehicle cable 91 extending from a piece of equipment or an accessory of the vehicle; a conductive core, such as copper wire or the like, for electrically connecting said contact means to said first end; and an outer substantially non-conductive covering such as a non-conductive rubber. Each of said cables 43 are similar to that of conventional electrical wiring used in motor vehicle electrical systems, and may be formed of various gages of cable or wire. Each cable 43 is securely affixed at a first end 41 to the rear surface 30R such that said inner conductive core is in electrical contact with the main body portion 30. A second end of the cable 43 is affixed to the contact means of this embodiment, which is a crimpable female fastener 42, for securely receiving a bare wire free end of said vehicle cable 91 and electrically affixing said wire 91 to the battery terminal. It is preferred that during the process for manufacturing the battery terminal connector 10, a first end 41 of each cable 43 be positioned within the cavity of the die casting mold used to form the flat body portion 30 of the battery terminal connector 10, for forming in said mold cavity with the molten metal introduced into said die casting mold, such that said cable 43 is made as an integral member of the battery terminal connector 10, securely affixed and electrically conductive. However, those skilled in the art will recognize other methods of securely affixing said flexible connector portion 40 into electrical contact with the flat body portion 30 which are within the scope of the present invention, one of which is described, hereafter and illustrated in the appended drawing. Those familiar with the efforts required in maintaining, repairing and replacing a wire which is part of a multiple wire cable harness will appreciate the convenience afforded in the use of said flexible connector portion 40. Instead of having to wrestle with a multitude of stiff vehicle cables connected to a single point, a user of the cable connector and repair system of the present invention has the luxury of being able to handle one cable and its associated connection to the battery terminal individually.

Further provided within the scope of the invention are means for removably affixing one or more cables extending from equipment or accessories of the vehicle into electrical contact with the battery terminal connector of the present invention. An embodiment of said means is included in the battery terminal connector 10 and illustrated in FIGS. 3, 4, 5 and 7 as a cable clamping plate 75 disposed in overlying relationship to the upper surface 30T for clamping one or more cables of the motor vehicle, including a large diameter cable 191, into electrical contact with the flat body portion 30 between the clamping plate 75 and said flat body portion 30. A pair of clamping plate apertures 75A extend through the opposite ends of the clamping plate 75 for receiving a pair of threaded bolts 73, which are for threadably connecting to the flat body portion 30 via said bolt receiving holes 32 and bolt receiving nuts 73N, thereby securely clamping one or more cables of the vehicle between the plate 75 and the flat body portion 30.

Further provided is a dimple or convex projection 75C formed in the clamping plate 75 in alignment with the channel 34 and opening away from the extending arms 21B and 21N, for securely clamping the insulated portion of the large diameter cable 191 to the flat body portion 30. The channel 34 and the convex projection 75C allow the clamping plate 75 to affix in electrical contact with the flat body portion 30 one or more vehicle cables 91 of smaller gage, simultaneously with the large diameter cable 191. Electrical contact between the bare wire ends of said vehicle cables and the flat body portion 30 is affected by placing the bare wire end of cable 191 within the channel 34, between the clamping plate 75 and the flat body portion 30, and likewise placing said bare wire ends of cables 91 between the clamping plate 75 and the flat body portion 30 on either side of the cable 191. The clamping plate 75 is drawn down tight toward the flat body portion 30 via said bolts 71 passing through the plate apertures 75A and the bolt receiving holes 32 of the flat body portion 30, into a threadable connection with said receiving nuts 73N.

Figure 9:
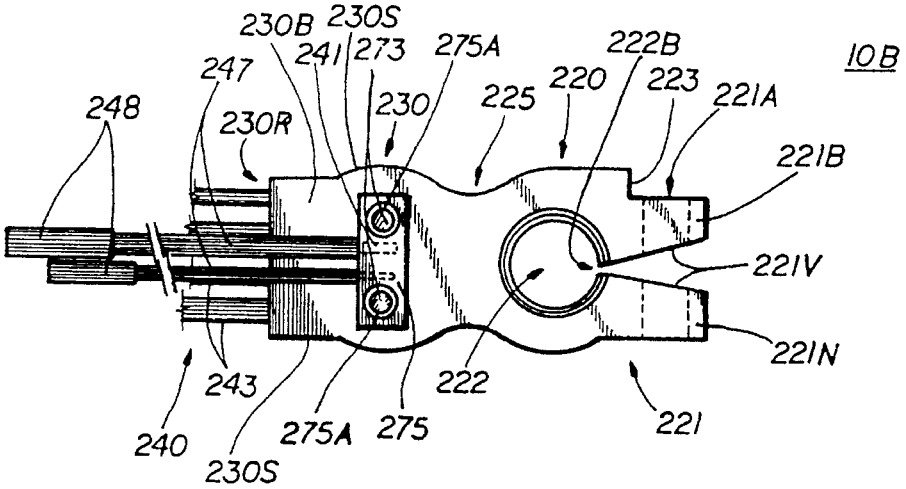
FIG. 9 is a bottom plan view of the body portion of another embodiment of the invention with associated cable clamp.

The clamping plate 75 affords the user of the battery terminal 10 of the present invention the ability to affix a number of vehicle cables into direct electrical contact with said flat body portion 30, and thereby increase the number of vehicle cables connected to the battery terminal. In FIG. 9 is illustrated an embodiment of a battery terminal connector 10B of the present invention, to which an even larger number of vehicle cables can be affixed into electrical contact with said battery terminal. Provided in this embodiment is a substantially flat lower cable clamping plate 275 positioned on a lower surface 230B for clamping one or more vehicle cables to the flat body portion 230 between the clamping plate 275 and said flat body portion 230, and for threadably securing a pair of clamping bolts 273 to a flat body portion 230 of said terminal connector 10B. This embodiment of the present invention is similar to that of the terminal connector 10 illustrated in FIGS. 1–7, in that it comprises an adapter portion 220, which further comprises a resilient battery terminal clamp 221 having a suitably tapered circular opening 222 therethrough for receivably connecting to a correspondingly tapered battery terminal, and a pair of outwardly extending arms 221B and 221N connected to the terminal clamp 221 at a bifurcated end 222B. Each extending arm 221N and 221B further includes an aligned aperture 221A therethrough for receiving the clamping bolt 71 (not shown), such that said clamping bolt 71 is perpendicular to the battery terminal and is prevented from turning via a ledge 223 formed at the rear of extending arm 221B. The outwardly extending arms 221N and 221B of this embodiment further comprise o opposing inner surfaces 221V flared outwardly from the circular opening 222 of the battery terminal clamp 221 for preventing said extending arms 221B and 221N from engaging each other when the battery terminal connector 10B is affixed to battery terminals of different sizes.

A flat body portion 230 is affixed in electrical contact to the adapter portion 220 via a neck portion 225, which is likewise affixed in electrical contact to the adapter portion 220 at a substantially right angle to the battery terminal and opposite the extending arms 221B and 221N. The flat body portion 230 is substantially flat on an upper surface 230T, a lower surface 230B, and side surfaces 230S, which are formed at substantially right angles to each other; and further includes a longitudinally extending groove or channel 234 in the upper surface 230T substantially similar to the channel 34 of the terminal connector 10 as illustrated in FIGS. 1 through 7. Said channel 234 extends across a width of the flat body portion 230 in a direction substantially perpendicular to a line drawn through the bolt receiving aligned apertures 221A. The flat body portion 230 further includes a pair of bolt receiving holes 232 coaxially extending through said flat body portion 230 substantially perpendicular to and on either side of said channel 234, and substantially similar to the receiving holes 32 of the terminal connector 10.

A substantially flat rear surface 230R of the flat body portion 230 is substantially perpendicular to said upper surface 230T and said lower surface 230B. Intersecting the rear surface 230R at substantially right angles is a flexible connector portion 240, which is substantially similar to the flexible connector portion 40 of the terminal connector 10, comprising a plurality of flexible connector segments, or insulated electrical cables 243. Each cable 243 is securely affixed at a first end 241 to the rear surface 230R such that an inner conductive core of each cable 243 is in electrical contact with the flat body portion 230. At a second end of the cable 43 is a crimpable female fastener 242 for securely receiving a free end of an electrical wire 91 of the motor vehicle and electrically affixing said wire 91 to the battery terminal.

An upper cable clamping plate 275T substantially similar to the cable clamping plate 75 of the terminal connector 10 is positioned in overlying relationship to the upper surface 230T of the flat body portion 230 for electrically affixing one or more vehicle cables to said flat body portion 230, and a second lower cable clamping plate 275 is positioned on the lower surface 230B for clamping one or more vehicle cables to the flat body portion 230 between the clamping plate 275 and said flat body portion 230. A pair of threaded clamping plate apertures 275A extend through opposite ends of the clamping plate 275 for receiving a pair of threaded bolts 273, which are for threadably connecting to the clamping plate 275. The clamping plates 275T and 275 are drawn down tight toward the flat body portion 230 via said bolts 273 passing through the clamping plate 275T, the bolt receiving holes 232 of the flat body portion 230, and into threadable connection with said clamping plate apertures 275A of the clamping plate 275T, for removably affixing into electrical contact with the battery terminal 10B any vehicle cables having conductive ends placed between said clamping plates and said flat body portion.

Further illustrated in FIG. 9 are a pair of removable flexible cable connectors 247 for removably affixing one or more vehicle cables to the flat body portion 230. Each cable connector 247 includes a conductive core similar to that found in a typical vehicle wire or cable, and means for affixing a first end 241 of said connector 247 into electrical contact with said flat body portion 230 and means for affixing a second end 248 into electrical contact 241 clamped between one of the clamping plates 275T or 275 to the flat body portion 230. Said second end means of the present embodiment is a crimpable female fastener 248, for receiving a bare wire end of a vehicle cable 91.

Figure 8:
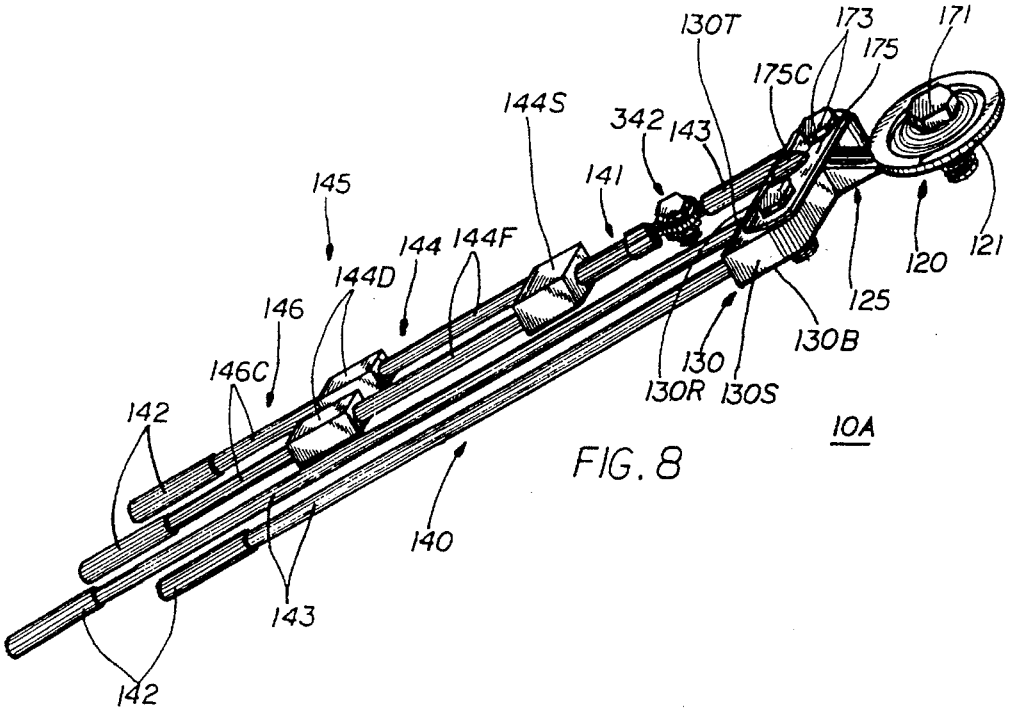
FIG. 8 is a perspective view of another embodiment of the invention.

In FIG. 8 is illustrated another embodiment of the battery terminal connector of the present invention, in which there is provided a battery terminal connector 10A for affixing one or more cables extending from equipment or accessories of a vehicle into electrical contact with a side post terminal of a vehicle battery. In this embodiment is provided a battery terminal adapter portion 120, comprising a substantially flat securing mount 121 affixed to a flat body portion 130 via a neck portion 125. Said securing mount 121 includes a rotatable threaded bolt 171 extending therethrough for threadably affixing said mount 121 to the side post terminal of a vehicle battery. The securing mount 121 is similar in appearance and function to the side post terminal connector element typical on most side post mounted vehicle cable harnesses, and may include the rotatable threaded bolt 171 affixed thereto, or include only a bolt receiving aperture for receiving said threaded bolt 171. The flat body portion 130 comprises: a plurality of substantially flat exterior surfaces including a top surface 130T, a bottom surface 130B, a pair of side surfaces 130S, and a rear surface 130R, all of said exterior surfaces being connected at substantially right angles to at least three of the other exterior surfaces. The flat body portion 130 further includes a longitudinally extending channel 134 in said top surface 130T extending across a width of the flat body portion 130 in a direction substantially parallel a line drawn through the rotatable threaded bolt 171 and the center of said top surface 130T for affixing a large diameter vehicle cable into electrical contact with the battery terminal connector 10A. Said fiat body portion 130 further includes a pair of bolt receiving apertures 130A coaxially extending through said fiat body portion 130 substantially perpendicular to and on either side of said channel 134. Further provided in this embodiment of the battery terminal 10A is a cable clamping plate 175 for removably affixing one or more vehicle cables into electrical contact with said fiat body portion 130. Said clamping plate 175 is substantially similar to the clamping plate 75 of the battery terminal connector 10, and is affixed in electrical contact to the fiat body portion via cooperation with a pair of clamping bolts 173.

Figure 11:
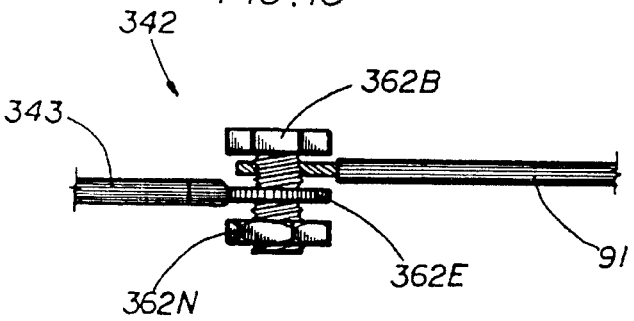
FIG. 11 is a side elevation view of the cable end fastener of FIG. 10.

A plurality of flexible connector segments 143 are affixed to the rear surface 130R of the terminal 10A in similar manner as the connector segments 43 are affixed to the rear surface 30R of the terminal connector 10. Further provided in this embodiment of the battery terminal connector as illustrated in FIG. 8 is another embodiment of the flexible connector portion of the present invention. This embodiment includes a flexible connector segment 145 having a first end portion 141, a fusible link portion 144, and a second end portion 146. Each of said end portions 141 and 146 includes a conductive core similar to that of electrical cables commonly used in motor vehicles. Said first end portion 141 is further removably affixed at a first end to one of said connector segments 143 via releasable connector means 342 (FIG. 11). Said connector segment 145 further includes a single fusible link 144S affixed between said first end portion 141 and said fusible link portion 144. Said fusible link portion 144 includes one or more wire-like fuses 144F, which are well known in the art, connected between said single fusible link 144S and one or more other fusible links 144D. Said one or more other fusible links 144D are each connected between one of said one or more wire-like fuses 144F and said second end portion. Said second end portion 146 includes a flexible cable segment 146C and a crimpable female fastener 142 for affixing said second end portion 146 into electrical contact with one of the vehicle cables 91. Those who have experienced replacing an entire vehicle cable harness upon the advent of a malfunctioning wire-like fuse of a fusible link assembly will appreciate the convenience and cost savings provided by this embodiment of the present invention.

Figures 12, 13:
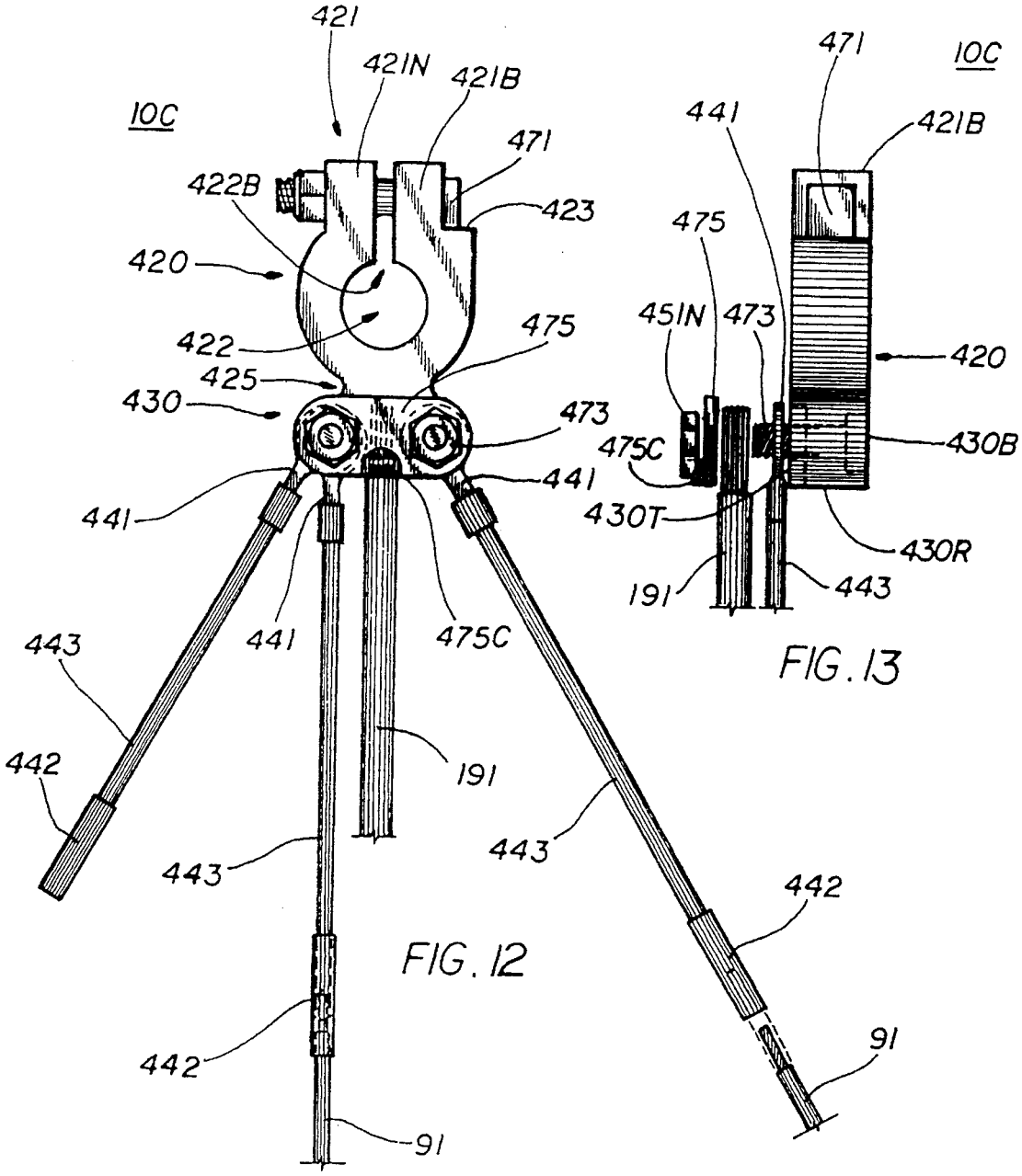
FIG. 12 is a top plan view of an other embodiment of the invention.
FIG. 13 is a side elevation view of FIG. 12.

An embodiment of the battery terminal connector repair system of the present invention is illustrated in FIGS. 12 and 13, in which another version of the flexible connector portion of the present invention, comprising means for removably affixing into electrical contact with a vehicle battery terminal one or more vehicle wires, is depicted. In this embodiment is provided a battery terminal connector 10C having a battery terminal adapter portion 420, which further comprises a resilient battery terminal clamp 421 having a suitably tapered circular opening 422 therethrough for receivably affixing to a correspondingly tapered battery terminal, and a pair of outwardly extending arms 421B and 421N connected to the terminal clamp 421 at a bifurcated end 422B. Each extending arm 421N and 421B further includes an aligned aperture 421A therethrough for receiving the clamping bolt 471, such that said clamping bolt 471 is perpendicular to the battery terminal and is prevented from turning via a ledge 423 formed at the rear of extending arm 421B.

A flat body portion 430 is affixed in electrical contact to the resilient battery terminal clamp 421 via a neck portion 425, which is likewise affixed in electrical contact to the adapter portion 420 at a substantially right angle to the battery terminal and opposite the extending arms 421B and 421N. The flat body portion 430 is substantially flat on an upper surface 430T, a lower surface 430B, a rear surface 430R and curvilinear side surfaces 430S, which are formed at substantially right angles to each other. The flat body portion 430 further includes a longitudinally extending groove or channel 434 in the upper surface 430T substantially similar to the channel 34 of the terminal connector 10 as illustrated in FIGS. 1 through 7, Said channel 434 is formed in the upper surface 430T extending across a width of the flat body portion 430 in a direction substantially perpendicular to the clamping bolt 471 when said bolt 471 is in operative position. The flat body portion 430 further includes a pair of threaded inlaid bolts 473 coaxially extending through said upper surface 430T of the flat body portion 430 substantially perpendicular to and on either side of said channel 434, for receiving a cable clamping plate 475 and a pair of correspondingly threaded securing nuts 451N.

The cable clamping plate 475 is substantially similar to the cable clamping plate 75 of the terminal connector 10, and is positioned in overlying relationship to the upper surface 430T of the flat body portion 430 for electrically affixing one or more vehicle cables to said flat body portion 430. The pair of threaded clamping plate apertures 475A extend through opposite ends of the clamping plate 475 for receiving said pair of inlaid bolts 473. The clamping plate 475 is drawn down tight toward the flat body portion 430 via said bolts 473 passing through the clamping plate 475 into threadable cooperation with said receiving nuts 451N, for removably affixing into electrical contact with the battery terminal 10C any vehicle cables having conductive ends placed between said clamping plate 475 and the flat body portion 430. A convex projection 475C, similar to the convex projection 75C of the battery terminal connector 10, is further provided in the clamping plate 475, for cooperation with the channel 434 in affixing a large diameter cable 191 therebetween.

Further illustrated in FIGS. 12 and 13 are a plurality of removable flexible cable connectors 443 for removably affixing one or more cables extending from equipment or accessories of the vehicle into electrical contact with said flat body portion 430, or for use when repairing any battery terminal connector having an inlaid bolt similar to that of the inlaid bolts 473 of the battery terminal connector 10C. Each cable connector 443 includes a conductive core similar to that found in a typical vehicle wire or cable, and contact means for affixing said conductive core at a first end 441 of said connector 443 into electrical contact with said flat body portion 430. Each cable connector 443 likewise includes contact means for affixing said conductive core at a second end into electrical contact with a vehicle cable 91. Said first end contact means includes a substantially flat metallic circular end 441 having a bolt receiving aperture therethrough for removable cooperation with one of the inlaid bolts 473. The receiving nuts 451N are provided for threadably receiving the inlaid bolts 473 and thereby affixing the cable connectors 443 into electrical contact with the battery terminal. Said second end contact means of the cable connector 443 is a crimpable female fastener 442, for receiving a free end of an electrical wire 91 of the motor vehicle and thereby affixing the wire 91 into electrical contact with the battery terminal.

Figure 10:
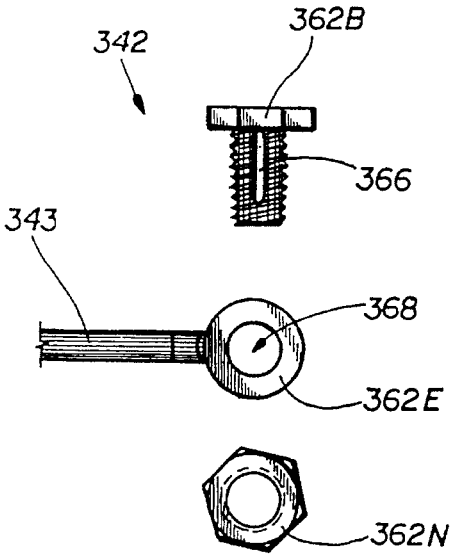
FIG. 10 is an exploded view of another embodiment of a cable end fastener of the present invention.

A modified form of said second end contact means for affixing a second end of each cable connector 443 into electrical contact with a vehicle cable 91, or likewise for affixing between a battery terminal connector and a vehicle cable 91, is illustrated in FIGS. 10 and 11. The modified second end contact means comprises a releasible connector means 342 affixed into electrical contact with the conductive core of a cable connector segment 343, and which includes a substantially flat metallic circular end 362E having a bolt receiving aperture 368 therethrough for receiving a threaded contact bolt 362B. Said contact bolt 362B includes an elongate wire receiving aperture 366 for receiving a free end of the vehicle cable 91. A contact nut 362N is provided for threadably receiving the contact bolt 362B and for affixing the cable connector segment 343 into electrical contact with the vehicle cable 91. Said removable flexible cable connectors 443 and releasible connector means 342 may be used in conjunction with either the battery terminal connectors of the present invention or as an element of the battery terminal connector repair system of the present invention, in which any battery terminal having a connecting bolt substantially similar to the inlaid bolts 473 illustrated in FIGS. 12 and 13 may be repaired and reconnected to wires or cables extending from vehicle equipment, via cutting away a corroded segment of each vehicle wire in need of repair and replacing same with said flexible cable connectors 443 or releasible connector means 342. Likewise, the flexible connector segment 145 illustrated in FIG. 8 is for use with the battery terminal connector repair system of the present invention when repairing and/or replacing vehicle cable segments having wire-like fuse and fusible link portions.

It is apparent from the foregoing that there is provided within the scope of the present invention a new and improved battery terminal connector and repair system for a motor vehicle battery terminal connector and electrical harness assembly, wherein a plurality of electrical cables may be readily and quickly accessed, maintained, removed, repaired and replaced; thereby, avoiding any need to remove the entire terminal connector or replace the entire vehicle wiring harness when only a segment of a few of the cables in electrical contact with the battery terminal are in need of said repair.

The inventor has given a non-limiting description of several embodiments of the invention, to which many changes may be made without deviating from the spirit of the invention. While this invention has been described with reference to various illustrative embodiments, this description is not intended to be construed in a limiting sense. Various modifications and combinations of the various embodiments as well as other embodiments of this invention will be apparent to a person skilled in the art upon reference to this description. Other changes such as those which are aesthetic, or those which include the substitution of other materials as they become available, which substantially perform the same function in substantially the same manner with substantially the same result without deviating from the spirit of this invention may be made. It is therefore contemplated that the appended claims cover any such modifications and/or embodiments that fall within the true scope of this invention.

It is claimed:

1. A battery terminal connector for a motor vehicle, comprising:

a battery terminal adapter portion for affixing the terminal connector into electrical contact with a battery terminal;

a body portion connected in electrical contact with the terminal adapter portion; and a flexible connector portion affixed in electrical contact between the body portion and a vehicle cable, the flexible connector portion comprising at least one flexible connector segment, wherein the segment includes a first end in electrical contact with the body portion, a second end, and a conductive core extending between the first end and second end, wherein the at least one flexible connector segment second end further includes contact means for securing a vehicle cable in electrical contact with the conductive core, wherein the contact means comprises a crimpable female fastener for securely receiving a free end of a vehicle cable.

2. A battery terminal connector for a motor vehicle, comprising:

a battery terminal adapter portion for affixing the terminal connector into electrical contact with a battery terminal;

a body portion connected in electrical contact with the terminal adapter portion; and a flexible connector portion affixed in electrical contact between the body portion and a vehicle cable, the flexible connector portion comprising at least one flexible connector segment, wherein the segment includes a first end in electrical contact with the body portion, and a conductive core extending between the first end and a second end of the segment wherein the first end of the at least one flexible connector segment is affixed to the body portion via placing the first end into a die casting mold for making the flat body portion, and subsequently introducing a molten metal into the die casting mold, whereby the first end is made an integral part of the flat body portion via a die casting process.

3. A battery terminal connector for a motor vehicle, comprising;

a battery terminal adapter portion for affixing the terminal connector into electrical contact with a battery terminal;

a flat body portion connected in electrical contact to the terminal adapter portion; and a flexible connector portion affixed in electrical contact to the flat body portion, the flexible connector portion comprising a plurality of flexible connector segments, each of which segments includes a first end affixed in electrical contact with the flat body portion, a conductive core extending between the first end and a second end, which second end includes a crimpable female fastener for securely receiving a free end of a vehicle cable.

4. The battery terminal connector of claim 3, wherein the first end of each of the plurality of flexible connector segments is affixed to the body portion via placing the first end into a die casting mold for making the flat body portion, and subsequently introducing a molten metal into the die casting mold, whereby the first end is made an integral part of the flat body portion via a die casting process.

* * * * *